US010821501B2

(12) United States Patent
Castle et al.

(10) Patent No.: US 10,821,501 B2
(45) Date of Patent: Nov. 3, 2020

(54) COATED CASTING CORE AND MANUFACTURE METHODS

(71) Applicant: United Technologies Corporation, Farmington, CT (US)

(72) Inventors: Lea D. Castle, Vernon, CT (US); Brandon W. Spangler, Vernon, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/200,970

(22) Filed: Nov. 27, 2018

(65) Prior Publication Data

US 2019/0091760 A1 Mar. 28, 2019

Related U.S. Application Data

(63) Continuation of application No. 15/036,216, filed as application No. PCT/US2014/062546 on Oct. 28, 2014, now Pat. No. 10,166,599.

(Continued)

(51) Int. Cl.

| | |
|---|---|
| ***B22C 9/10*** | (2006.01) |
| ***B22C 3/00*** | (2006.01) |
| ***B22C 7/02*** | (2006.01) |
| ***B22C 9/24*** | (2006.01) |
| ***B22C 9/12*** | (2006.01) |
| ***B22D 25/02*** | (2006.01) |

(Continued)

(52) U.S. Cl.

CPC ..... *B22C 9/103* (2013.01); *B22C 3/00* (2013.01); *B22C 7/02* (2013.01); *B22C 9/108* (2013.01); *B22C 9/12* (2013.01); *B22C 9/24* (2013.01); *B22D 25/02* (2013.01); *B22D 29/001* (2013.01); *B22D 29/04* (2013.01); *F01D 5/28* (2013.01); *F01D 9/02* (2013.01); *F01D 5/284* (2013.01); *F05D 2220/32* (2013.01); *F05D 2230/21* (2013.01); *F05D 2300/175* (2013.01)

(58) Field of Classification Search

CPC .. B22C 9/103; B22C 9/12; B22C 9/24; B22C 3/00; B22C 7/02; B22C 25/02; B22D 29/001; B22D 29/004; B22D 25/02

See application file for complete search history.

(56) References Cited

U.S. PATENT DOCUMENTS

| | | | |
|---|---|---|---|
| 3,824,113 | A | 7/1974 | Loxley et al. |
| 4,703,806 | A | 11/1987 | Lassow et al. |

(Continued)

FOREIGN PATENT DOCUMENTS

| | | |
|---|---|---|
| EP | 1524045 A2 | 4/2005 |
| EP | 1543896 A2 | 6/2005 |

OTHER PUBLICATIONS

European Search Report dated Feb. 15, 2019 for European Patent No. 18210071.9.

(Continued)

*Primary Examiner* — Kevin P Kerns
*Assistant Examiner* — Steven S Ha
(74) *Attorney, Agent, or Firm* — Bachman & LaPointe, P.C.

(57) ABSTRACT

A casting core assembly includes a metallic core, a ceramic core having a compartment in which the portion of the metallic core is received, and a ceramic coating at least partially covering the metallic core and the ceramic core.

17 Claims, 10 Drawing Sheets

Related U.S. Application Data

(60) Provisional application No. 61/905,542, filed on Nov. 18, 2013.

(51) Int. Cl.

| | |
|---|---|
| ***B22D 29/00*** | (2006.01) |
| ***B22D 29/04*** | (2006.01) |
| ***F01D 5/28*** | (2006.01) |
| ***F01D 9/02*** | (2006.01) |

(56) References Cited

U.S. PATENT DOCUMENTS

| | | | |
|---|---|---|---|
| 4,787,439 | A | 11/1988 | Feagin |
| 5,143,777 | A | 9/1992 | Mills |
| 6,637,500 | B2 | 10/2003 | Shah et al. |
| 6,929,054 | B2 | 8/2005 | Beals et al. |
| 7,014,424 | B2 | 3/2006 | Cunha et al. |
| 7,134,475 | B2 | 11/2006 | Snyder et al. |
| 7,438,527 | B2 | 10/2008 | Albert et al. |
| 8,251,123 | B2 | 8/2012 | Farris et al. |
| 2007/0056709 | A1 | 3/2007 | Schmidt et al. |
| 2007/0089850 | A1 | 4/2007 | Beals et al. |
| 2007/0221359 | A1 | 9/2007 | Reilly |
| 2008/0277090 | A1 | 11/2008 | Luczak et al. |
| 2010/0116452 | A1 | 5/2010 | Luczak et al. |
| 2010/0122789 | A1* | 5/2010 | Piggush ..... B22C 7/02 164/28 |
| 2012/0168108 | A1 | 7/2012 | Farris et al. |

OTHER PUBLICATIONS

International Search Report and Written Opinion dated Oct. 28, 2014 for PCT/US2014/062546.

European Search Report dated May 9, 2017 for European Patent Application No. 14861754.1.

U.S. Office Action dated Jan. 9, 2018 for U.S. Appl. No. 15/036,216.

* cited by examiner

COATED CASTING CORE AND MANUFACTURE METHODS

CROSS-REFERENCE TO RELATED APPLICATIONS

This is a continuation of U.S. patent application Ser. No. 15/036,216, filed May 12, 2016, entitled "Coated Casting Cores and Manufacture Methods", which is a 371 U.S. national stage application of PCT/US2014/062546, filed Oct. 28, 2014, which claims benefit of U.S. Patent Application No. 61/905,542, filed Nov. 18, 2013, and entitled "Coated Casting Cores and Manufacture Methods", the disclosures of which are incorporated by reference herein in their entireties as if set forth at length.

BACKGROUND

The disclosure relates to investment casting. More particularly, it relates to the formation of investment casting of cores.

Investment casting is a commonly used technique for forming metallic components having complex geometries, especially hollow components, and is used in the fabrication of superalloy gas turbine engine components. The disclosure is described in respect to the production of particular superalloy castings, however it is understood that the disclosure is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al., U.S. Pat. No. 6,929,054 of Beals et al., U.S. Pat. No. 7,014,424 of Cunha et al., U.S. Pat. No. 7,134,475 of Snyder et al., U.S. Pat. No. 7,438,527 of Albert et al., and U.S. Pat. No. 8,251,123 of Farris et al. (the disclosures of which are incorporated by reference herein as if set forth at length) disclose use of ceramic and refractory metal core combinations. In such situations, the refractory metal cores may be pre-coated with a ceramic coating (e.g., alumina).

SUMMARY

One aspect of the disclosure involves a casting core assembly comprising a metallic core. A ceramic core has a compartment in which the portion of the metallic core is received. A ceramic coating at least partially covers the metallic core and the ceramic core.

In additional or alternative embodiments of any of the foregoing embodiments, a ceramic adhesive joint may be between the portion and the ceramic core.

In additional or alternative embodiments of any of the foregoing embodiments, the ceramic core is an airfoil feed-core and the metallic core is an outlet core.

In additional or alternative embodiments of any of the foregoing embodiments, the metallic core is a refractory metal core.

In additional or alternative embodiments of any of the foregoing embodiments, the ceramic core is silica-based.

In additional or alternative embodiments of any of the foregoing embodiments, the coating comprises at least 50% mullite and/or alumina by weight.

In additional or alternative embodiments of any of the foregoing embodiments, the coating is a single sole layer atop both the ceramic core and the metallic core.

Another aspect of the disclosure involves a pattern having an assembly of the foregoing embodiments and a wax material in which the assembly is partially embedded.

Another aspect of the disclosure involves a mold having the assembly of any of the foregoing embodiments and a shell, the metallic core having a distal portion embedded in the shell and the metallic core spanning a gap between the ceramic core and the shell.

In additional or alternative embodiments of any of the foregoing embodiments, a process for forming the assembly process comprises: molding the ceramic core over the portion of the metallic core; and applying the coating.

In additional or alternative embodiments of any of the foregoing embodiments, the process further comprises applying an additional ceramic coating to the metallic core.

In additional or alternative embodiments of any of the foregoing embodiments, the applying of the coating is to the ceramic core in an unfired state.

In additional or alternative embodiments of any of the foregoing embodiments, the applying is by chemical vapor deposition.

In additional or alternative embodiments of any of the foregoing embodiments, the metallic core comprises a by-weight majority of one or more refractory metals.

In additional or alternative embodiments of any of the foregoing embodiments, the process is a portion of a pattern-forming process which further comprises overmolding a main pattern-forming material to the core assembly in a pattern-forming die.

In additional or alternative embodiments of any of the foregoing embodiments, the process is a portion of a shell-forming process. The shell-forming process further comprises: shelling the pattern; removing the main pattern-forming material; and hardening the shell.

In additional or alternative embodiments of any of the foregoing embodiments, the process is a portion of a casting process. The casting process further comprises: introducing molten metal to the shell; allowing the metal to solidify; and destructively removing the shell and the core assembly.

In additional or alternative embodiments of any of the foregoing embodiments, the ceramic core forms a feed passageway in an airfoil and the metallic core forms an outlet passageway from the feed passageway to a pressure side or a suction side of the airfoil.

The details of one or more embodiments are set forth in the accompanying drawings and the description below.

Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
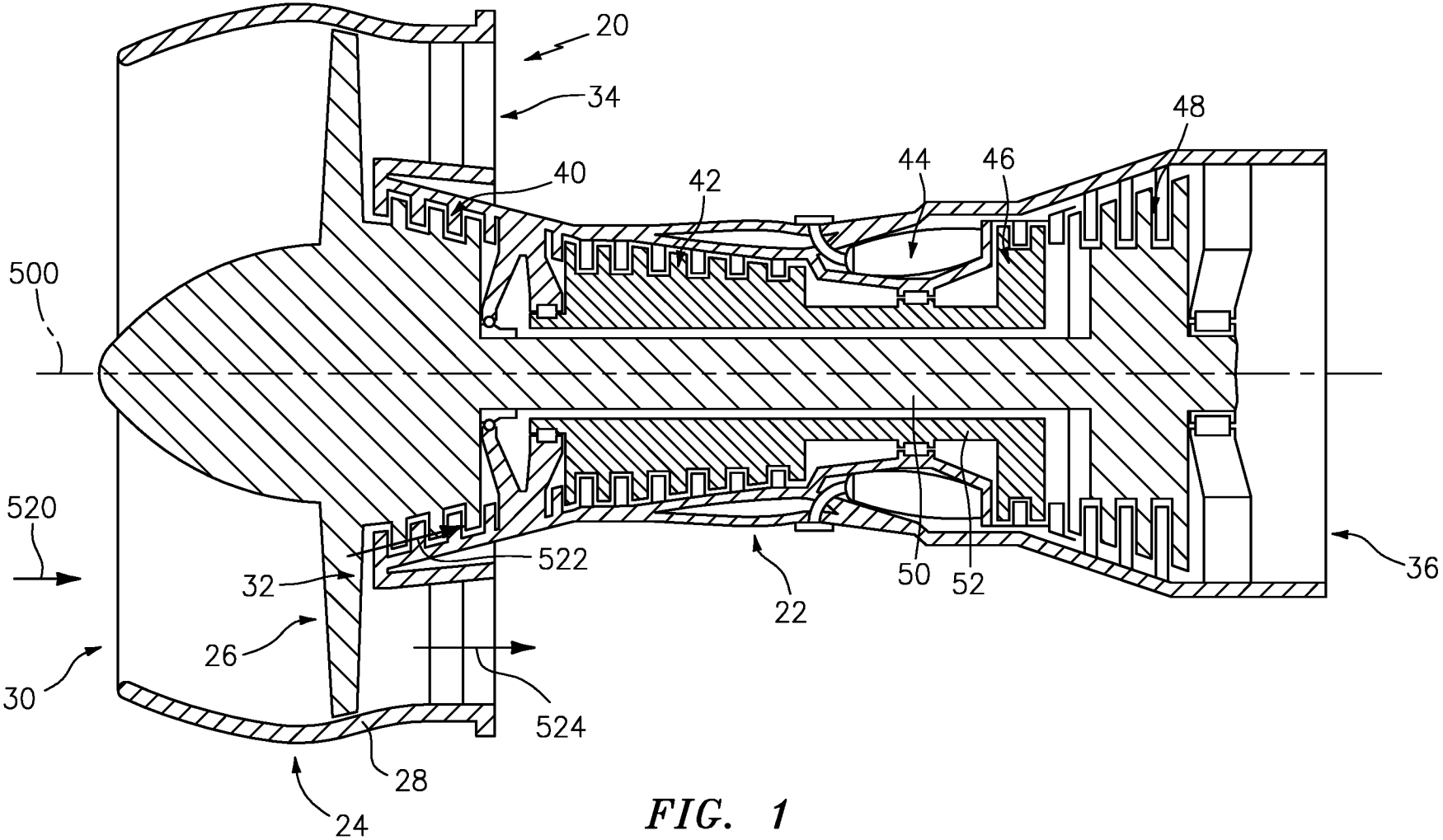
FIG. 1 is a schematized longitudinal sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages of fan blades 32. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also directly drives the fan. In alternative implementations, the fan may be driven via a transmission (e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
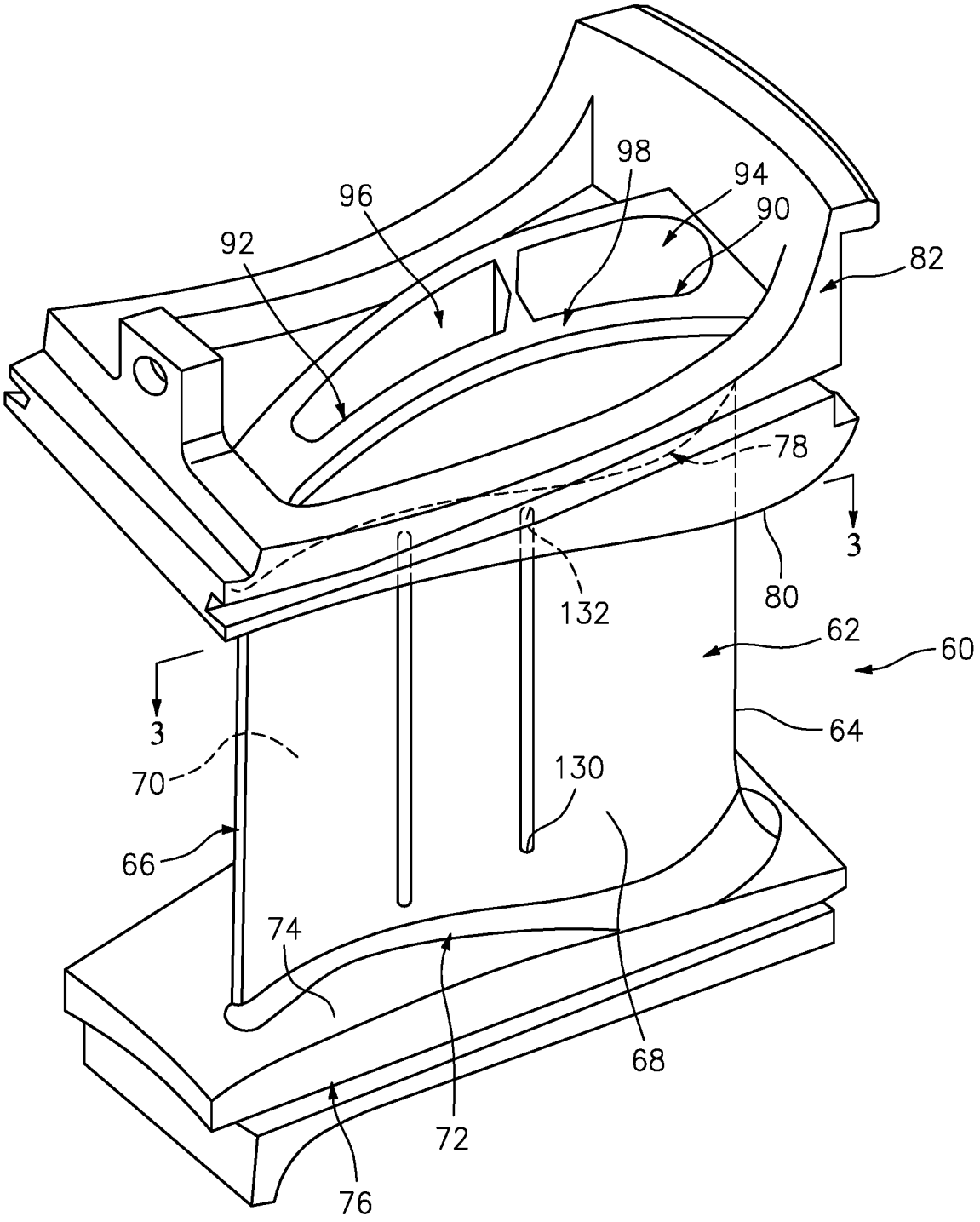
FIG. 2 is a view of a turbine vane of the engine of FIG. 1.

FIG. 2 shows an exemplary cast turbine element 60 of one of the turbine sections. The exemplary casting is of a nickel-based superalloy or a cobalt-based superalloy. The exemplary element 60 is an airfoil element such as a blade or vane, in this example, a vane. The vane comprises an airfoil 62 extending from a leading edge 64 to a trailing edge 66 and having a pressure side 68 and a suction side 70. The airfoil extends along a span from an inboard (inner diameter (ID)) end 72 along the outer (outboard) surface (gas path-facing surface) 74 of a platform 76. The airfoil extends to an outboard (outer diameter (OD)) end 78 at the inboard surface (gas path-facing surface) 80 of an outer diameter (OD) shroud 82.

Figure 3:
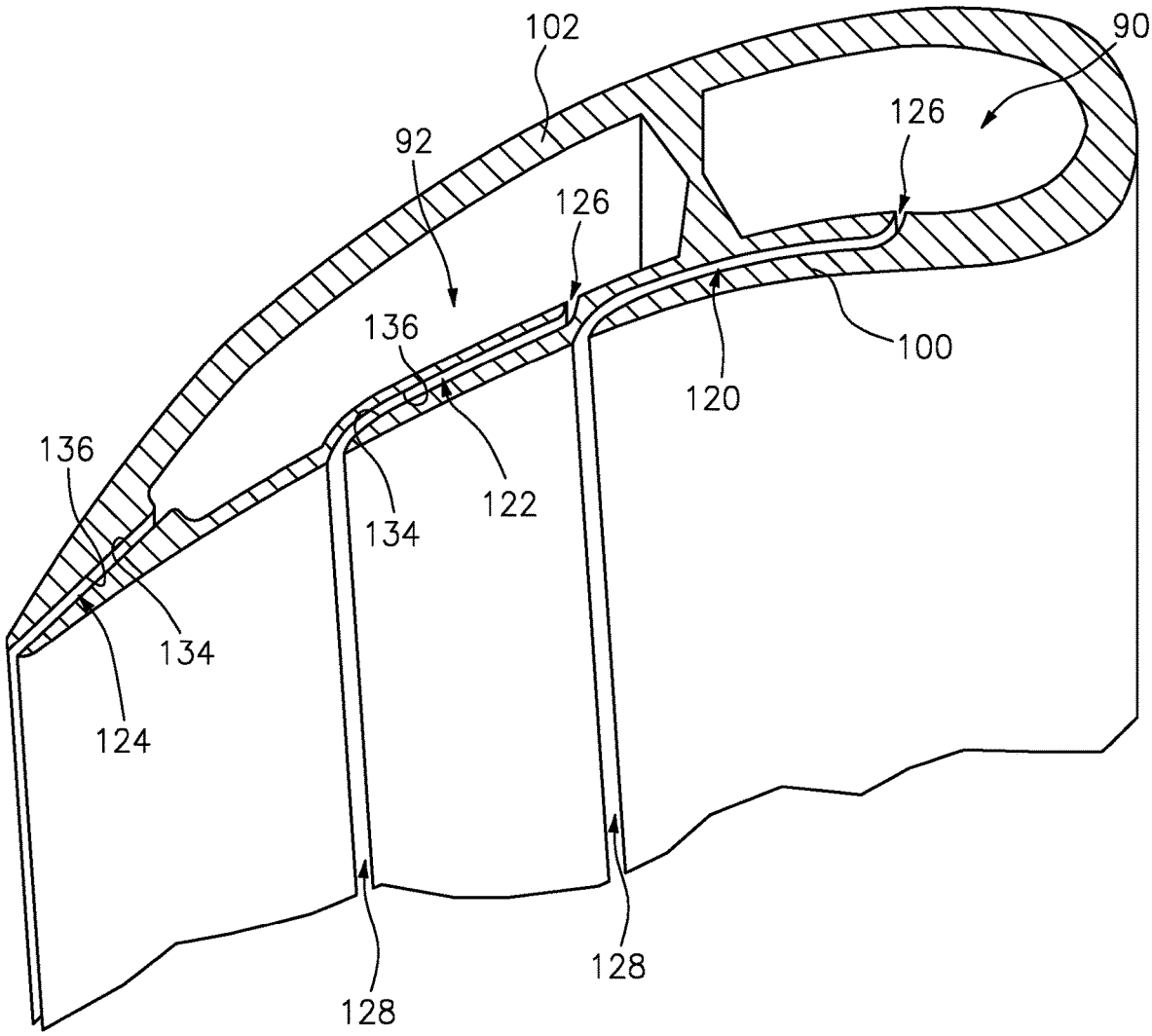
FIG. 3 is a cutaway view of the vane of FIG. 2, taken along line 3-3.

The element 60 has a passageway system for passing cooling air through the airfoil. The exemplary system includes one or more (e.g., two) passageway trunks 90, 92. Exemplary passageway trunks have inlets 94, 96 along the OD face 98 of the OD shroud 82 for receiving cooling air (e.g., air bled from the compressor(s)). FIG. 3 further shows a pressure side sidewall 100 and a suction side sidewall 102 with the legs 90 and 92 therebetween.

FIG. 3 further shows the passageway system as including a plurality of outlet (discharge) passageways 120, 122, 124 (shown slot-like) extending from one or more associated inlets 126 along one or more of the associated passageway trunks (which serve as feed passageways) 90 and 92 to one or more associated outlets 128 along the exterior surface of the airfoil. In the exemplary embodiment, the outlets of the passageways 120 and 122 are along the pressure side 68 of the airfoil and the outlet of the passageway 124 is along the trailing edge.

Spanwise, the passageways 120, 122, 124 extend from an inboard (inner diameter (ID)) end 130 to an outboard (outer diameter (OD)) end 132 (FIG. 2). The passageway inlet 126 or outlet 128 may be segmented as is known in the art. Additionally, within the passageway, various posts, pedestals, or other surface enhancements may be present.

There may be a variety of additional outlet passageways. For example, these may include pluralities of individual holes (e.g., drilled or cast) along the airfoil or along the platform or shroud. Additionally, the feed passageways 90, 92 may open to the ID face of the ID platform to deliver cooling air to further locations (or, alternatively receive cooling air if flow were reversed and there were platform inlets).

FIG. 3 further shows the outlet passageways as each having a first face 134 and a second face 136. For the passageways 120 and 122, the face 134 is generally close to the adjacent outer surface of the airfoil whereas the face 136 is close to the surface of the associated leg 90 and/or 92. For the passageway 124, the surfaces are generally respectively toward the pressure side and suction side.

Figure 4:
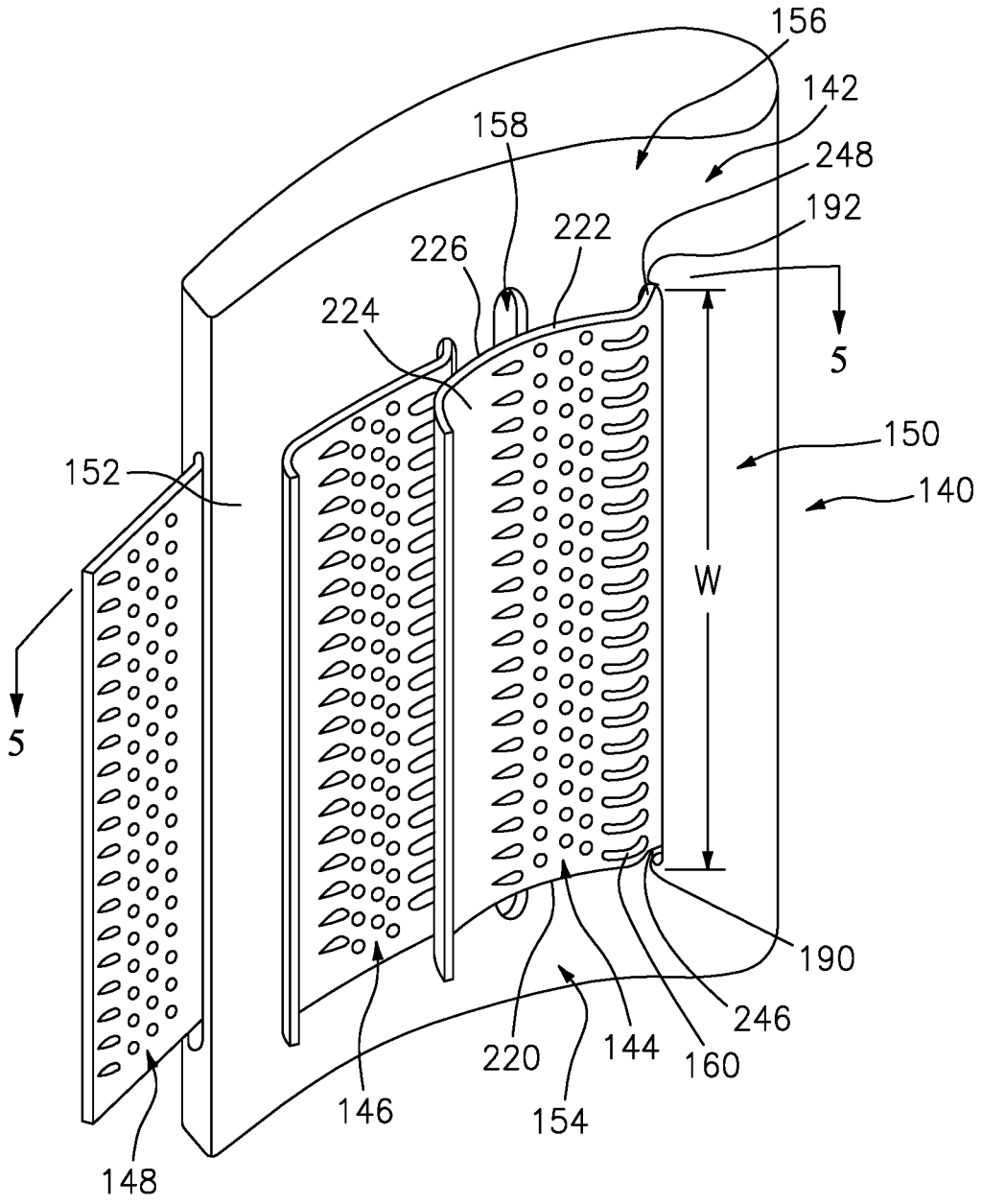
FIG. 4 is a view of a core assembly for casting the vane of FIG. 2.

FIG. 4 is a view of a casting core assembly 140 for forming the vane of FIG. 2. The core assembly includes one or more ceramic feedcores 142 and one or more metallic cores 144, 146, and 148 (e.g., refractory metal cores (RMC)). Exemplary RMCs are refractory metal based (i.e., having substrates of at least fifty weight percent one or more refractory metals such as molybdenum, tungsten, niobium, or the like, optionally pre-coated) as discussed below.

The exemplary feedcore 142 comprises two legs 150 and 152 respectively for casting the feed passageways 90 and 92. At respective inboard and outboard ends of the legs 150 and 152, the feedcore includes end portions 154 and 156 linking the two legs and providing mechanical integrity. Thus, a gap 158 is formed between the legs.

The exemplary RMCs 144, 146, and 148 are configured to cast the respective outlet passageways 120, 122, and 124. Each of the RMCs includes a plurality of apertures 160 of appropriate shape for casting post features in the associated outlet passageway.

Figure 5:
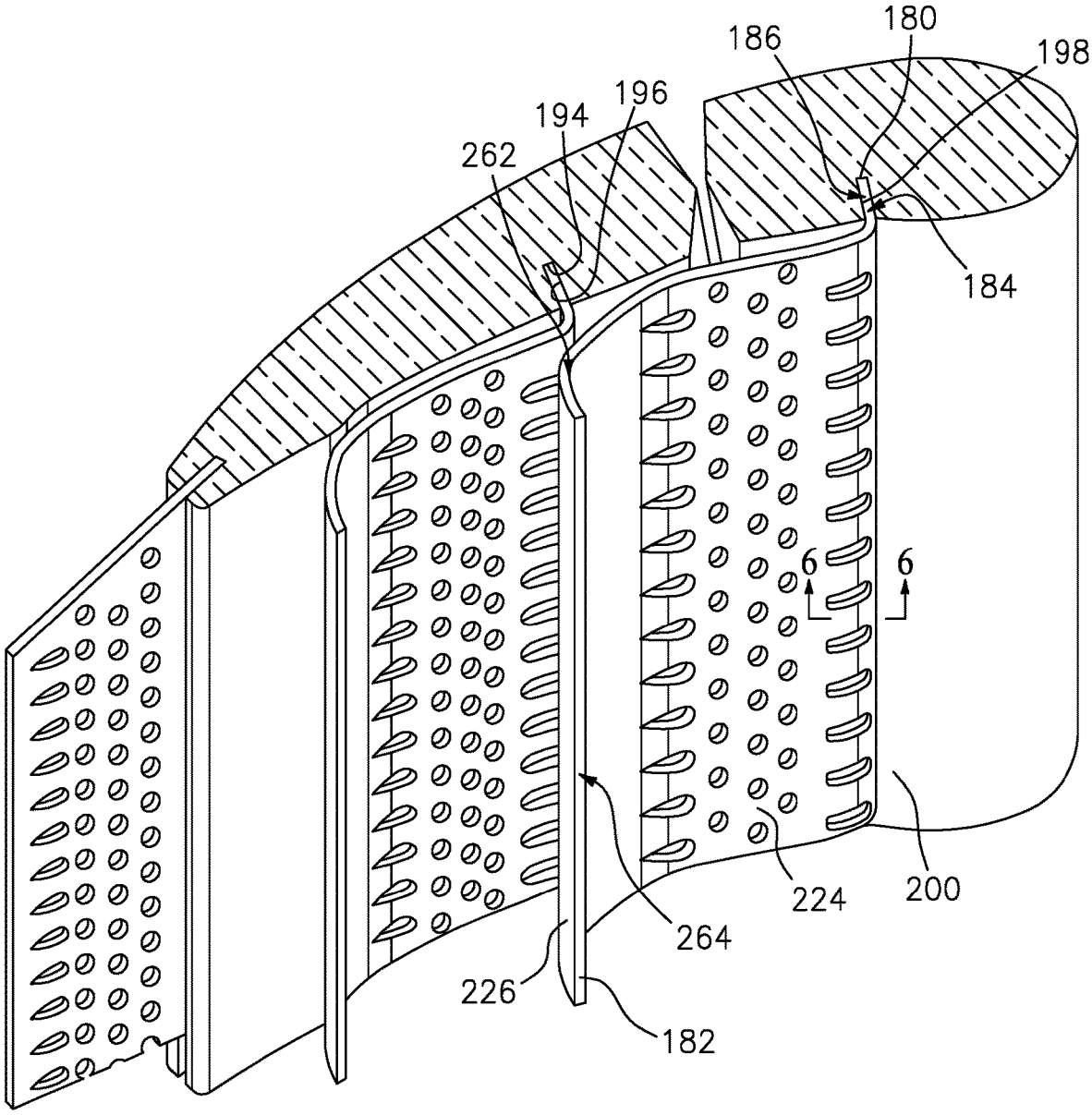
FIG. 5 is a cutaway view of the core assembly of FIG. 4, cutaway along line 5-5 of FIG. 4.

FIG. 5 shows further details of the exemplary RMCs.

Each of the RMCs extends from a proximal edge 180 to a distal edge 182. As is discussed further below, a portion 184 near the proximal edge 180 is within the ceramic core. This may be achieved either by molding the ceramic core over the portion 184 or inserting the portion 184 into a pre-formed complementary blind channel or slot (compartment) 186 of the associated leg of the ceramic core. Each exemplary slot 186 extends spanwise from a first end 190 (FIG. 4) to a second end 192. The exemplary first end 190 is an inboard/ID end and the exemplary second end 192 is an outboard/OD end. The exemplary slots 186 further include a base 194 and a pair of lateral faces or sidewalls 196 and 198 extending outward from the base 194 to a slot opening along a main surface portion 200 of the feedcore. Exemplary slots 186 are elongate, having a distance between ends 190 and 192 substantially greater than a width between faces 196 and 198 (e.g., at least five times greater, more particularly, at least ten times or 10-50 times).

The exemplary RMCs each have an inboard/ID end 220 (FIG. 4) and an outboard/OD end 222. The exemplary RMCs further include a first face 224 and a second face 226. The exemplary faces 224 and 226, along a majority portion of a streamwise length between the edges 180 and 182 respectively face away from the feedcore and face toward the feedcore.

Figure 6:
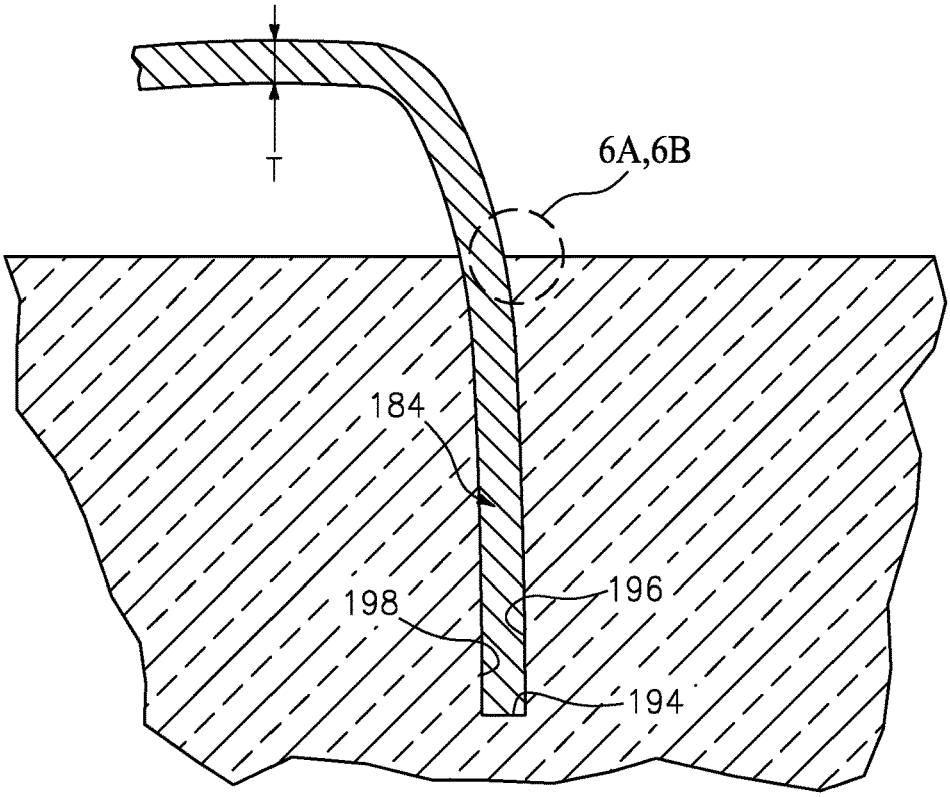
FIG. 6 is a sectional view of the assembly of FIG. 5, taken alone line 6-6 of FIG. 5.
Figure 6A:
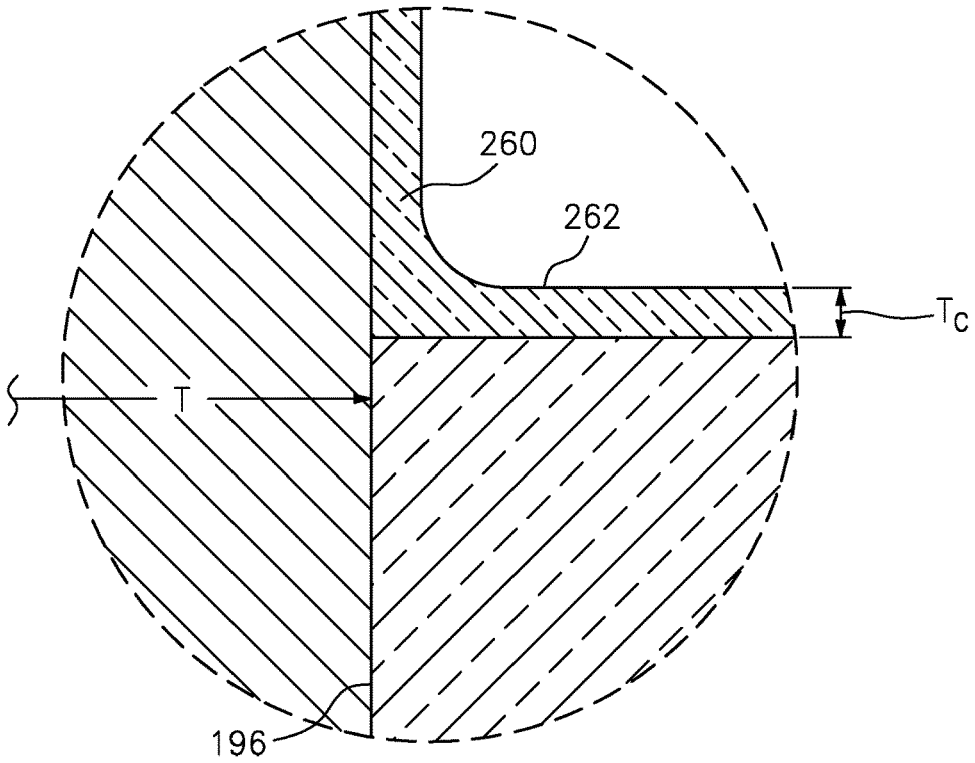
FIG. 6A is a first enlarged view of a joint in the assembly of FIG. 6.

FIG. 6 shows the RMC portion 184 embedded or received in the feedcore. For an exemplary sheetstock RMC, an exemplary thickness T is five mil to thirty mil (0.127 mm to 0.762 mm), more particularly, ten mil to twenty mil (0.254 mm to 0.508 mm). FIG. 6A shows a coating layer 260 covering both the RMC and feedcore and having an exposed outer surface 262. In this embodiment, the coating 260 may cover essentially all of the exposed portions both of the RMC and the feedcore. Alternatively, it may cover smaller portions. In one example, it covers just the joints (e.g., discussed further below). Exemplary thickness $T_c$ of the coating is 0.1 mil to 2 mil (2.54 micrometer to 50.8 micrometer), more particularly, 0.5 mil to 1.5 mil (12.7 micrometer to 38.1 micrometer). Such thicknesses may be measured as a local thickness, or a median, mean, modal, or other average thickness (at least over an area to which coating is applied).

Figure 6B:
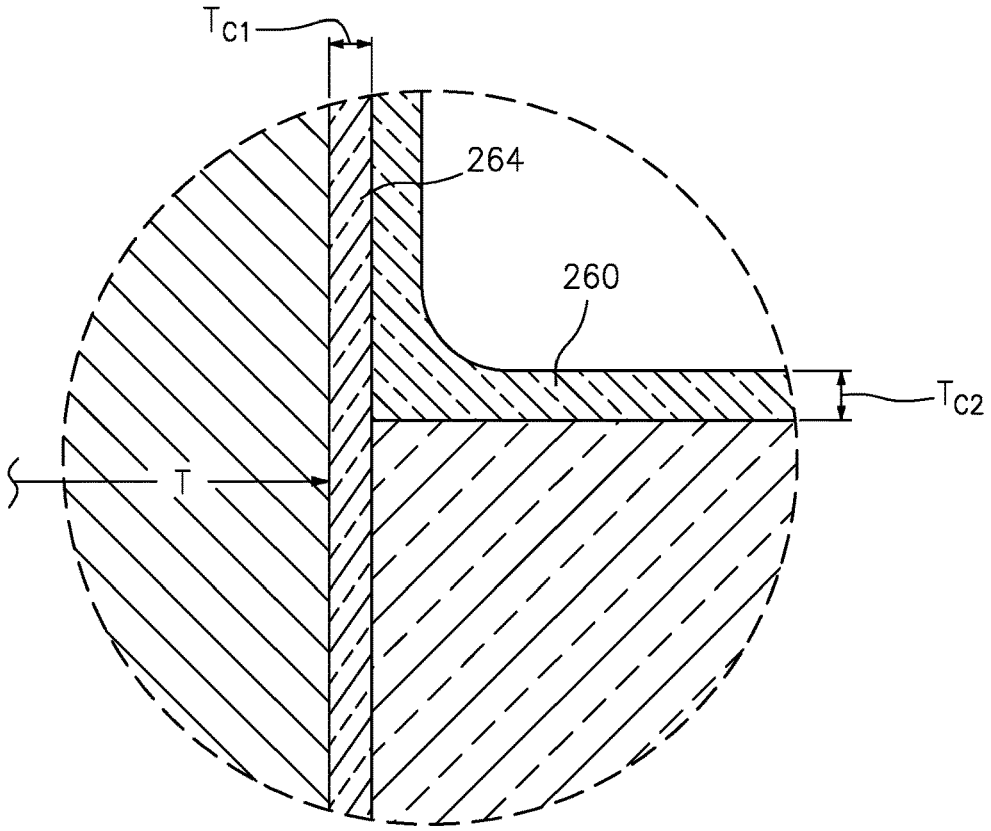
FIG. 6B is an alternative enlarged view of the joint assembly of FIG. 6.

FIG. 6B shows an alternative variation wherein the RMC is pre-coated with a coating 264 so that the coating 260 is applied over the feedcore and the coating 264. The coating 262 may be single or multilayer and further options are discussed below. In this situation, the coating 260 may have a benefit of repairing damage to the coating 264. For example, if the ceramic is molded over the coated RMC or a pre-molded ceramic feedcore is mated to the RMC with adhesive, the molding and/or assembly process may damage the coating 264 leaving gaps. Applying the coating 260 will tend to cover these gaps. In this situation, it may be particularly relevant to apply the coating 260 along only the joint or with greater thickness near the joint.

Figure 6C:
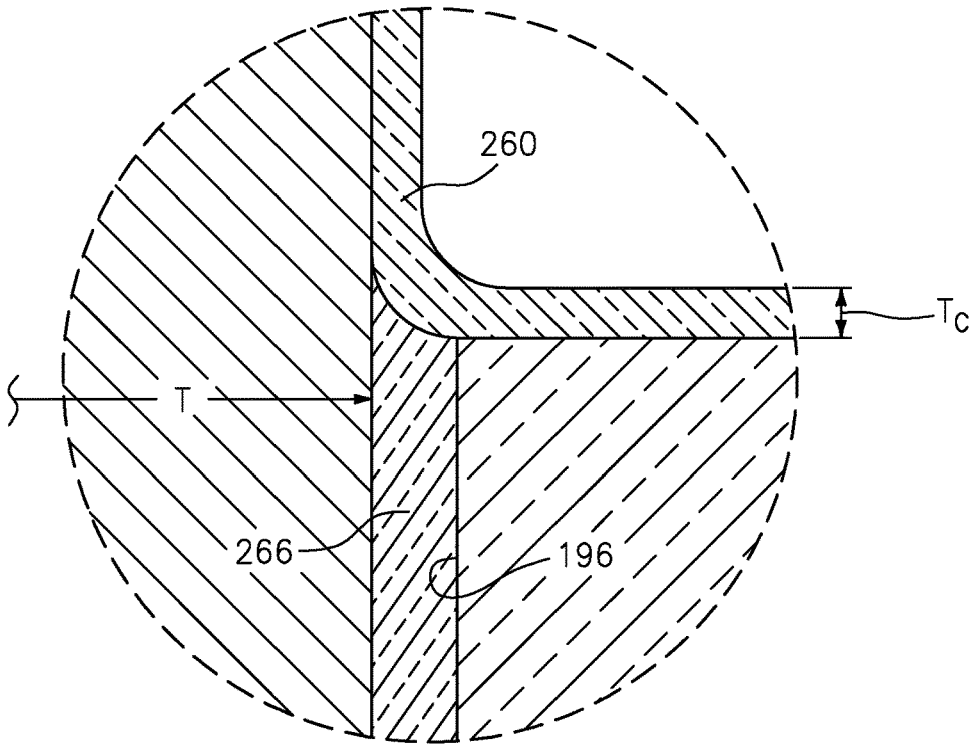
FIG. 6C is an alternative enlarged view of the joint assembly of FIG. 6.
Figure 7:
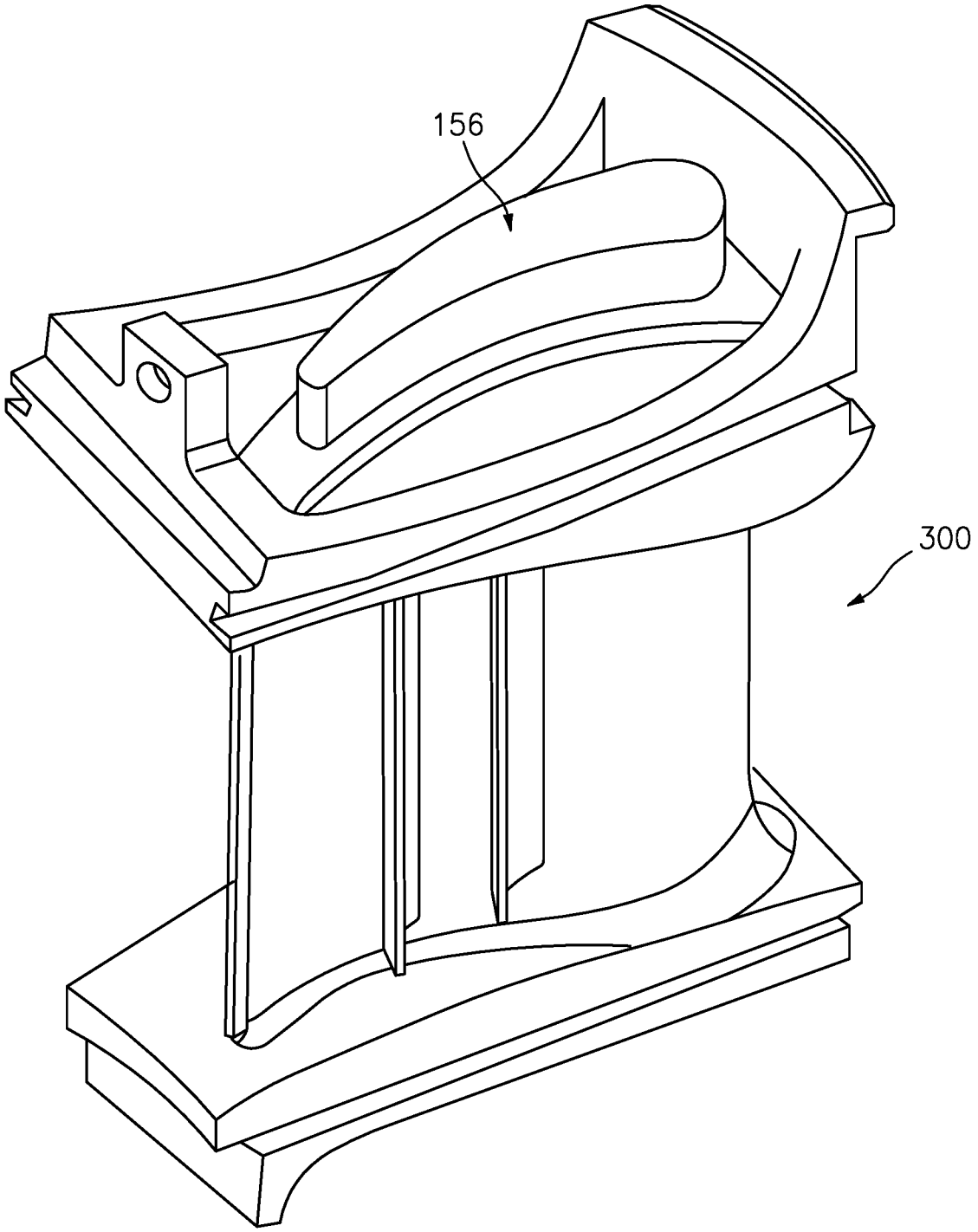
FIG. 7 is a view of a pattern assembly comprising the core assembly of FIG. 2.
Figure 8:
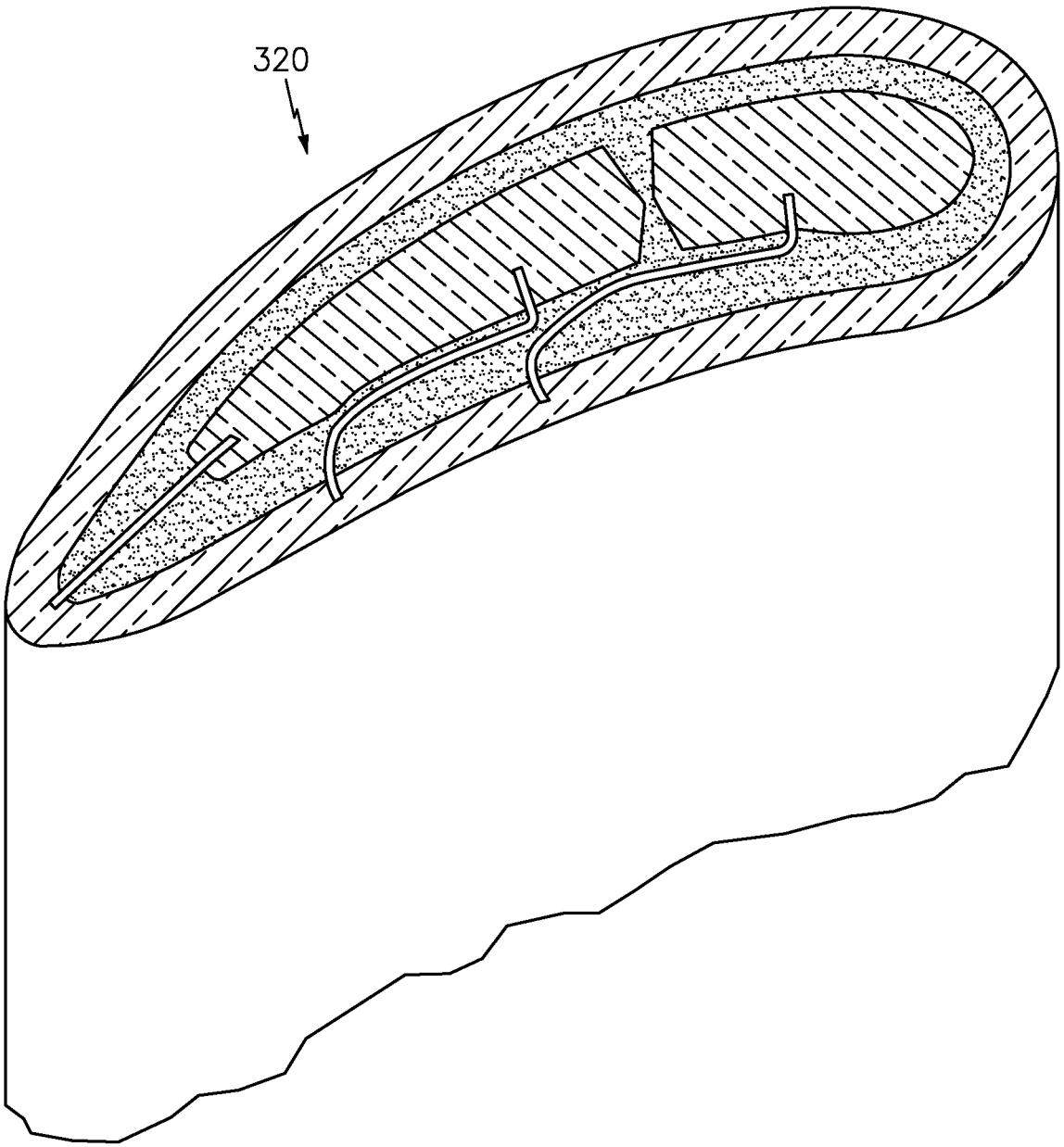
FIG. 8 is a cutaway view of the pattern assembly of FIG. 7 after shelling.

FIG. 6C shows an alternative variation differing from FIG. 6A in that the feedcore is pre-molded and a slot is pre-formed (e.g., molded or cut) and a ceramic adhesive 266 is injected into the slot (e.g., prior to insertion of the RMC or after).

An exemplary method 400 of RMC manufacture is from sheet stock (e.g., molybdenum or molybdenum alloy (e.g., 50% molybdenum by weight). Features may be cut 402 in an RMC blank and then the blank may be formed 404 into a desired shape. An alternative process involves cutting and forming (shaping) in a single stage such as a stamping. Other steps may be included such as a deburring and/or blasting.

Yet other alternatives involve an additive manufacture process where the RMC is built up from a powdered refractory metal such as molybdenum or combinations noted above.

The RMC may be coated 410 with the coating 264 (e.g., to isolate the RMC from the molten casting alloy (to protect the alloy) and prevent oxidation of the refractory metal components). A variety of coatings are known. An exemplary coating is an aluminide and/or aluminum oxide (e.g., a platinum aluminide applied via chemical vapor deposition (CVD)) and/or mullite.

Figure 9:
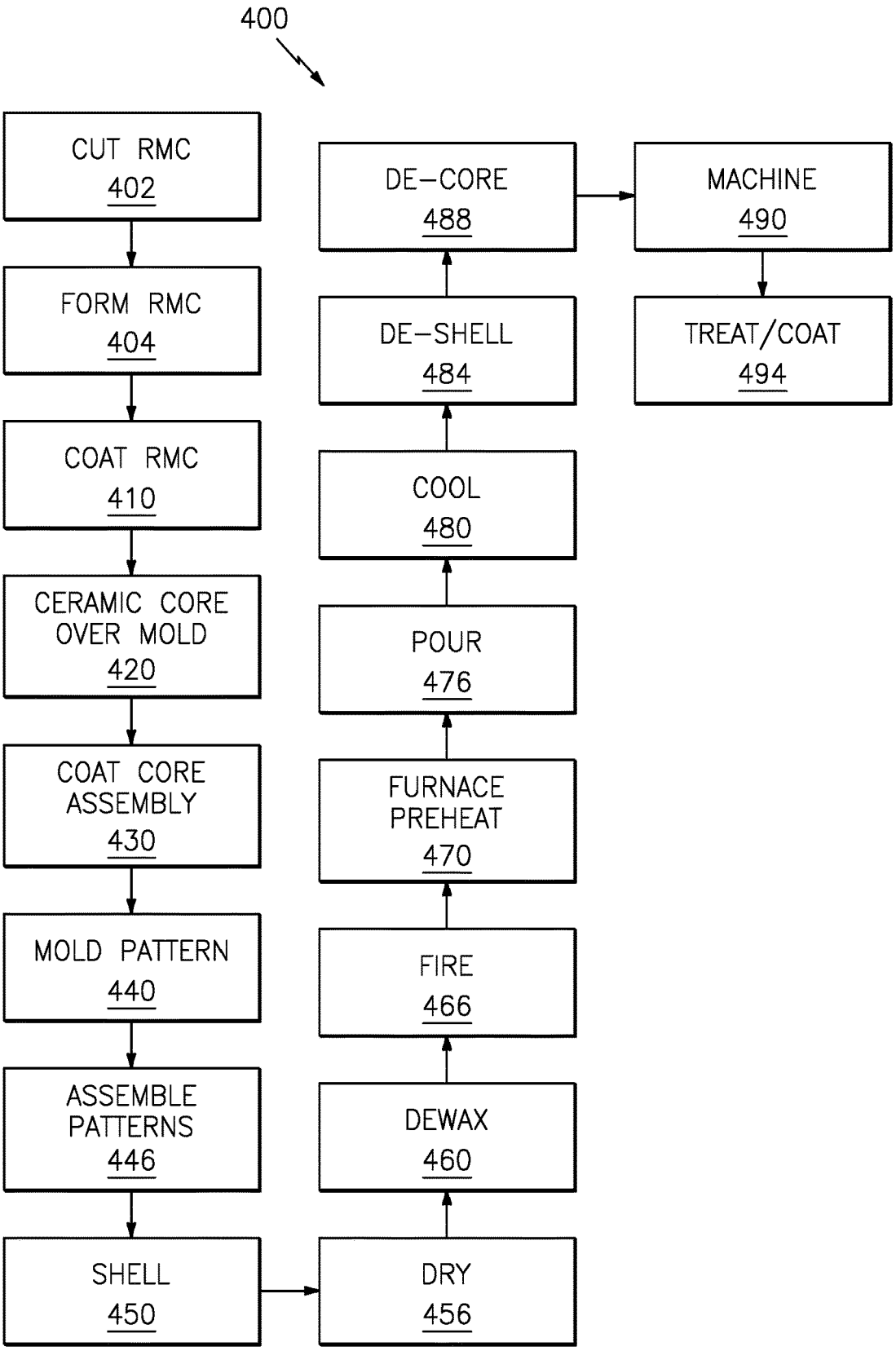
FIG. 9 is a flowchart of manufacture steps.

The feedcore may be pre-molded and, optionally, pre-fired. The feedcore may then be assembled to the RMC and optionally adhered via a ceramic adhesive. However, in the exemplary FIG. 9 embodiment, it is molded over (overmolded) 420 the RMC(s). This overmolding may involve positioning the RMCs (whether coated or not) in a core-molding die with the aforementioned portions 184 protruding into the die cavity. The exemplary molding involves molding a mixture of a ceramic powder and binder. The molding may compact the mixture to form a green compact. Thereafter, the core may be fired or otherwise heated to at least partially harden the core and remove the binder. The exemplary embodiment, however, leaves the ceramic green. Exemplary ceramic feedcore material is a fused silica with a paraffin binder injected to mold and then fired (e.g., at above 2000° F. (1093° C.)) to sinter/harden and burn off or volatize the paraffin. An alternative is a similar fused alumina or a mixture of alumina and silica. Another alternative is a castable ceramic (e.g., silica and/or alumnina) in an aqueous or colloidal silica carrier which then dries to harden. Such material is often used as an adhesive or shell patch.

After assembly of the RMC to the feedcore (insertion or overmolding), and optionally after any joint between the RMC and feedcore has sufficiently hardened (dried/cured) or the feedcore has partially hardened the resulting core assembly may then be transferred to a coating station for application 430 of the coating 260 (e.g., as one or more layers) which may be similar to the optional coating of step 410 above but which coats both the feedcore and the RMC(s).

Particularly where the RMC is precoated, this coating step 430 may apply coating to a relatively smaller portion of the RMC than of the feedcore. With the exemplary coating step 430 involving CVD, the heating attendant to CVD may act to at least partially harden the feedcore and, thereby, avoid need for a separate firing step (either before 430 or after 430). However, such firing steps may be included.

After coating, the resulting core assembly may then be transferred to a pattern-forming die. The pattern-forming die defines a compartment containing the core assembly into which a pattern-forming material is injected to mold 440 the pattern-forming material over the core assembly. The exemplary pattern-forming material may be a natural or synthetic wax.

The overmolded core assembly (or group of assemblies) forms a casting pattern (not shown) with an exterior shape largely corresponding to the exterior shape of the part to be cast. One or more of the patterns may then be assembled 446 to a shelling fixture (not shown, e.g., via wax welding between end plates of the fixture). The pattern may then be shelled 450 (e.g., via one or more stages of slurry dipping, slurry spraying, or the like). After the shell (not shown) is built up, it may be dried 456. The drying provides the shell with at least sufficient strength or other physical integrity properties to permit subsequent processing. For example, the shell containing the core assemblies may be disassembled fully or partially from the shelling fixture and then transferred to a dewaxer (e.g., a steam autoclave). In the dewaxer, a steam dewax process 460 removes the wax leaving the core assembly secured within the shell. The shell and core assemblies will largely form the ultimate mold. However, the dewax process typically leaves a residue on the shell interior and core assemblies.

After the dewax, the shell may be transferred to a furnace (e.g., containing air or other oxidizing atmosphere) in which it is heated 466 to strengthen the shell and remove any remaining wax residue (e.g., by vaporization) and/or converting hydrocarbon residue to carbon. Oxygen in the atmosphere then reacts with the carbon to form carbon dioxide. This heating 466 may also, if necessary, act to further harden/fire the feedcore ceramic.

The mold may be removed from the atmospheric furnace, allowed to cool, and inspected. The mold may be seeded by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred to a casting furnace (e.g., placed atop a chill plate (not shown) in the furnace). The casting furnace may be pumped down to vacuum or charged with a non-oxidizing atmosphere (e.g., inert gas) to prevent oxidation of the casting alloy. The casting furnace is heated 470 to preheat the mold. This preheating serves two purposes: to further harden and strengthen the shell (including the feedcores); and to preheat the shell for the introduction of molten alloy to prevent thermal shock and premature solidification of the alloy.

After preheating and while still under vacuum conditions, the molten alloy may be poured 476 into the mold and the mold is allowed to cool 480 to solidify the alloy (e.g., after withdrawal from the furnace hot zone). After solidification, the vacuum may be broken and the chilled mold removed from the casting furnace. The shell may be removed in a deshelling process 484 (e.g., mechanical breaking of the shell).

The core assembly is removed in a decoring process 488 such as alkaline and/or acid leaching (e.g., to leave a cast article (e.g., a metallic precursor of the ultimate part)). The cast article may be machined 490, chemically and/or thermally treated and coated 494 to form the ultimate part. Some or all of any machining or chemical or thermal treatment may be performed before the decoring.

One or more embodiments have been described. Nevertheless, it will be understood that various modifications may be made. For example, details of the particular components being manufactured will influence or dictate details (e.g., shapes, particular materials, particular processing parameters) of any particular implementation. Thus, other core combinations may be used. Accordingly, other embodiments are within the scope of the following claims.

What is claimed is:

1. A casting core assembly comprising:
a metallic core;
a ceramic core having a compartment in which a portion of the metallic core is received; and
a ceramic coating at least partially covering the metallic core and the ceramic core and having a median thickness of 0.5 mil to 1.5 mil,
wherein:
the coating is a single sole layer atop both the ceramic core and the metallic core.

2. A process for forming a casting core assembly, the process comprising:
molding a ceramic core over a portion of a metallic core; and
after the molding, applying a ceramic coating at least partially covering the metallic core and the ceramic core.

3. The process of claim 2 further comprising:
applying an additional ceramic coating to the metallic core before the molding.

4. The process of claim 2 wherein:
the applying of the ceramic coating is to the ceramic core in an unfired state.

5. The process of claim 2 wherein:
the applying is by chemical vapor deposition.

6. The process of claim 2 further wherein:
the metallic core comprises a by-weight majority of one or more refractory metals.

7. The process of claim 2 being a portion of a pattern-forming process, the pattern-forming process further comprising:
overmolding a main pattern-forming material to the core assembly in a pattern-forming die.

8. The process of claim 7 being a portion of a shell-forming process, the shell-forming process further comprising:
shelling the pattern; and
removing the main pattern-forming material and hardening the shell.

9. The process of claim 8 being a portion of a casting process, the casting process further comprising:
introducing molten metal to the shell;
allowing the metal to solidify; and
destructively removing the shell and the core assembly.

10. The process of claim 9 wherein:
the ceramic core forms a feed passageway in an airfoil; and
the metallic core forms an outlet passageway from the feed passageway to a pressure side or a suction side of the airfoil.

11. A process for forming a casting core assembly, the process comprising:
inserting a portion of a metallic core into a pre-formed compartment in a ceramic core; and
after the inserting, applying a ceramic coating at least partially covering the metallic core and the ceramic core.

12. The process of claim 11 further comprising:
injecting a ceramic adhesive into the compartment before the applying of the ceramic coating.

13. The process of claim 11 wherein:

the applying of the ceramic coating is to the ceramic core in an unfired state.

14. The process of claim 11 wherein:

the applying of the ceramic coating is to a median thickness of 0.5 mil to 1.5 mil.

15. The process of claim 11 wherein:

the ceramic core is an airfoil feedcore;

the metallic core is an outlet core;

the metallic core is a refractory metal core; and the ceramic core is silica-based.

16. The process of claim 11 wherein:

the coating comprises at least 50% mullite and/or alumina by weight.

17. A casting process comprising forming according to claim 11 a casting core assembly, the casting process comprising:

forming according to claim 11 said casting core assembly;

forming a pattern by partially embedding the casting core assembly in a wax material;

forming a shell by shelling the pattern;

dewaxing the shell; and casting metal in the shell.

* * * * *